United States Patent [19]

Trostler

[11] Patent Number: 4,593,177

[45] Date of Patent: Jun. 3, 1986

[54] REDUCED DIFFERENTIAL, HIGH LIMIT THERMOSTAT SYSTEM

[75] Inventor: Richard M. Trostler, Claremont, Calif.

[73] Assignee: Purex Pool Products, Inc., Lakewood, Calif.

[21] Appl. No.: 612,059

[22] Filed: May 18, 1984

[51] Int. Cl.[4] ..... F24H 1/00; H05B 1/00; H05B 3/02; H05B 1/02

[52] U.S. Cl. ..... 219/328; 219/494; 219/511; 219/308; 219/306; 219/296

[58] Field of Search ..... 219/280, 281, 486, 501, 219/511, 322, 328, 296, 297, 306, 327, 330, 494, 308

[56] References Cited

U.S. PATENT DOCUMENTS

| | | | |
|---|---|---|---|
| 2,611,850 | 9/1952 | Walton | 219/511 |
| 2,830,164 | 4/1958 | Weber et al. | 219/511 X |
| 3,538,310 | 11/1970 | Moyer et al. | 219/511 |
| 3,892,946 | 7/1975 | Rimmi | 219/486 |
| 4,315,142 | 2/1982 | Hénault | 219/511 |
| 4,349,726 | 9/1982 | Gössler | 219/511 |

*Primary Examiner*—Clifford C. Shaw
*Assistant Examiner*—M. M. Lateef
*Attorney, Agent, or Firm*—William W. Haefliger

[57] ABSTRACT

Thermostatic control of heating, as for a pool or spa, involves use of a heat source including a main heat generator and a mounting body, and includes:

(a) a main high limit thermostat mounted in such relation to the body as to receive heat therefrom.

(b) a thermal isolator plate operatively sandwiched between the body and thermostat, and (c) a heat conduction plate operatively sandwiched between the body and thermostat, there being an auxiliary heat source located to separately heat the heat conduction plate to cause heat flow to the thermostat, (d) the thermostat connected to interrupt operation of the main heat generator and operation of said auxiliary heat source in response to heating of the thermostat to a predetermined high temperature.

12 Claims, 5 Drawing Figures

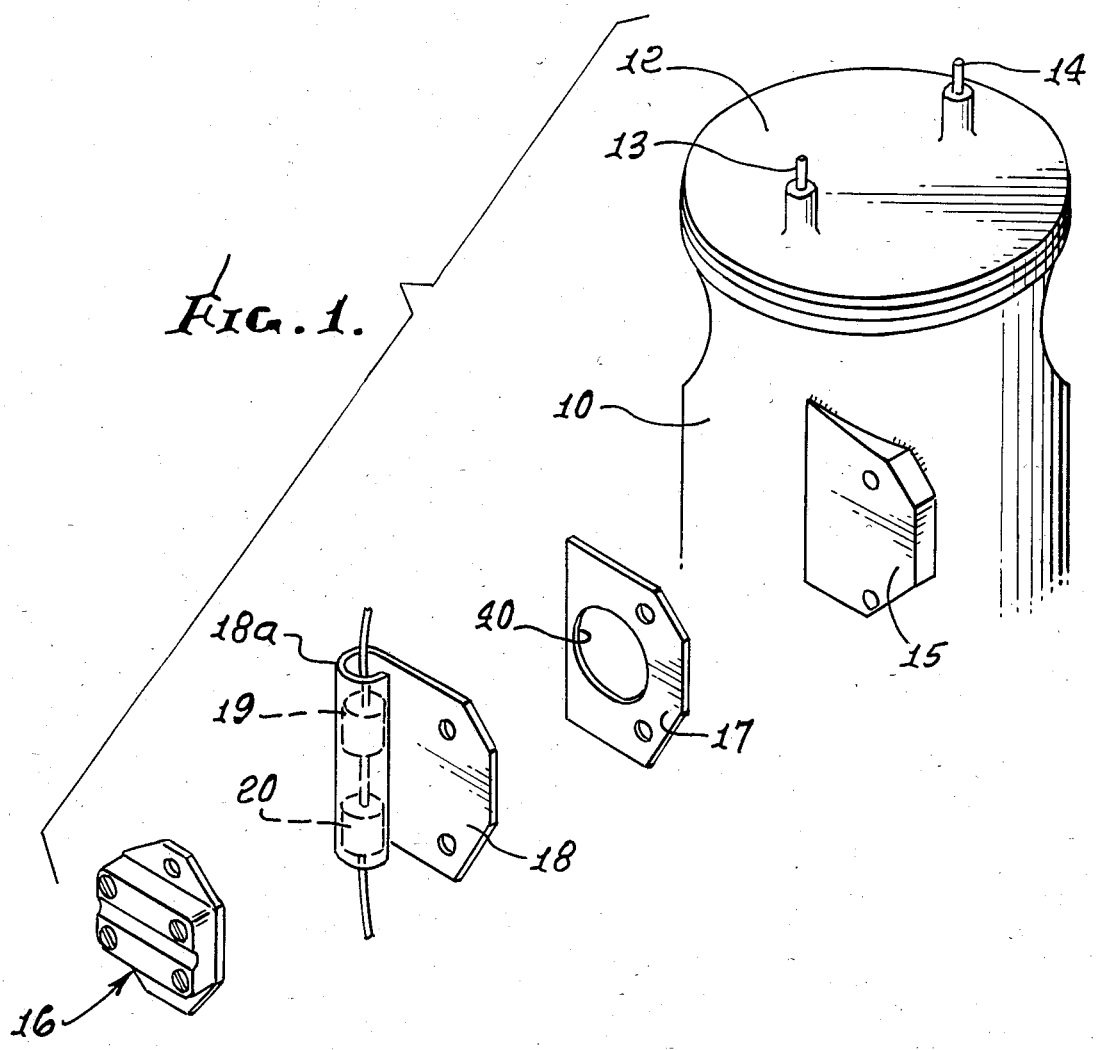
FIG. 1.
FIG. 2.
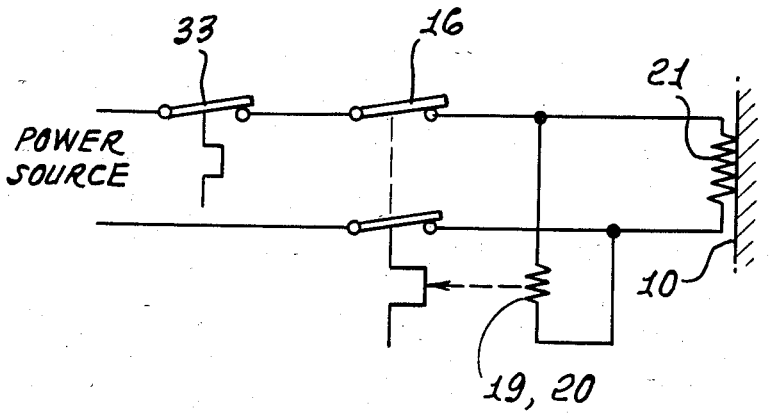

REDUCED DIFFERENTIAL, HIGH LIMIT THERMOSTAT SYSTEM

BACKGROUND OF THE INVENTION

This invention relates generally to thermostat control of heating, and more specifically to means for lowering the effective trip temperature of a high limit thermostat and for raising its effective reset temperature, all relative to the temperature of a heat source to be controlled.

A high limit thermostat is required for electric spa heaters (by Underwriters Laboratories Inc.), to insure that if the adjustable water temperature regulating thermostat fails, the maximum temperature that the water can attain will be within a relatively safe range. The first standard written by UL established that temperature to be 158° F. The standard required that the high limit thermostat must trip at a temperature lower than that maximum; it must break both sides of the line; it must have a manual reset arrangement; and it must be independent of the adjustable regulating thermostat. In addition, the manual reset mechanism must be "trip free", meaning that if the reset button is held manually, it will not prevent the thermostat from breaking the circuit if it reaches its trip temperature. A thermostat to meet the above high limit requirements is known in the art, one example being Therm-O-Disc, Inc. model HL.

A later standard imposed by UL for electric spa heaters used with spa equipment reduced the maximum allowable water temperature to 122° F. This lower temperature considerably increased the problems involved in providing a suitable thermostat, especially for high wattage heaters in the 11.5 KW range. The larger the current needed to be switched, the larger would be the differential between the thermostat trip temperature and its reset temperature. These thermostats use a bimetal disc as a sensing and contact activation means, the disc snapping over center like the bottom of an oil can. At the 122° F. maximum requirement, the temperature that the disc must be lowered to, to cause it to reset, is in the 60 to 70 degree F. range. If the thermostat should trip in warm weather, it requires special cooling techniques to cause it to reset. Since the trip tolerance available is, at best, ±5° F., the trip temperature can be as low as 112° F., and the reset temperature in the 60° to 80° F. degree range, At that low trip temperature, a heater sitting unused in the heat of the sun can become hot enough to cause the thermostat to trip.

One expedient that can be resorted to in answer to this problem is to use a low current thermostat which has a low differential to sense the temperature. Such a thermostat could be used to de-activate a contactor which is capable of switching the higher current levels and can be connected with a latching circuit to make it manually resettable. The disadvantages to this system are that the required contactor is large and expensive, and the additional reset switch is required. It also must be manually reset every time the power is interrupted. There is a need for a low cost, simple solution to these discussed problems.

SUMMARY OF THE INVENTION

It is a major object of the invention to provide the above needed solution. Basically, it is adapted for combination with a heat source including a main heat generator and a mounting body, the apparatus including:

(a) a main high limit thermostat mounted in such relation to said body as to receive heat therefrom, (b) a thermal isolator plate operatively sandwiched between said body and said thermostat, and (c) a heat conduction plate operatively sandwiched between said body and said thermostat, there being an auxiliary heat source located to separately heat the heat conduction plate to cause heat flow to said thermostat via said conduction plate, (d) said thermostat connected to interrupt operation of said main heat generator and operation of said auxiliary heat source in response to heating of the thermostat to a predetermined high temperature.

As will appear, the main heat generator may typically comprise an electrically energized heating element; the body may contain a cavity or passage for reception of water to be heated and to flow, as to a spa or swimming pool; and the body may consist of brass and have a mounting surface to which the described isolator plate, heat conduction plate and thermostat are mounted or connected, in stacked sequence or relation.

Further, the heat conductor plate may have an extended metallic portion with which auxiliary heater electrical resistance is in contact, and that extended portion may define a roll with the electrical resistance located in that roll, for simplicity, the isolator plate may consist of plastic material.

Finally, a manually adjustable thermostat may be connected in electrical series with the main high limit thermostat; and an auxiliary high limit thermostat may be placed across the terminals of the main high limit thermostat in series with the auxiliary heater, for unusually advantageous purposes as will appear.

These and other objects and advantages of the invention, as well as the details of an illustrative embodiment, will be more fully understood from the following specification and drawings, in which:

DRAWING DESCRIPTION

FIG. 1 is an exploded view of elements of the invention;

FIG. 1*a* is a side illustration showing the position of the FIG. 1 elements in stacked, mounted relation, operatively connected, electrically, and in water flow series with a spa or pool;

FIG. 2 is an electrical circuit diagram;

DETAILED DESCRIPTION

The invention basically enables the operation of a high-current, high limit main thermostat (with a trip temperature of about 130 degrees F., for example) to be modified by a small, inexpensive auxiliary heater, causing the main thermostat to trip below maximum allowable temperature (around 122° F., for example).

Figure 1A:
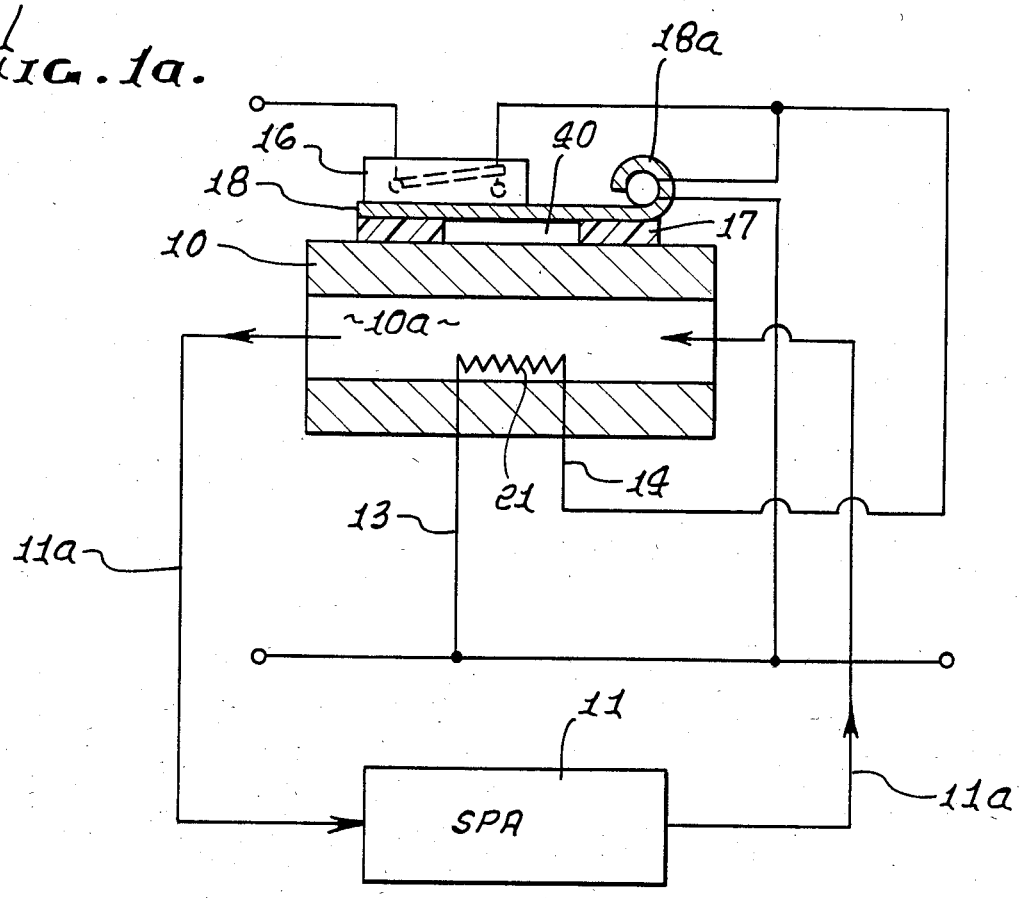

In the first version of the invention, and referring to FIGS. 1, 1*a* and 2, a brass body 10 contains a passage 10*a* for water flow to a spa or pool 11, as via water lines 11*a*. The water is typically to be heated in body 10, as indicated by heat generating resistor or resistors 21 which are electrically energized. Some of such heat is transferred via body 10 to a main high limit thermostat 16 mounted in such relation to body 10 as to receive heat therefrom. Also shown are:

(i) a thermal isolator plate or means (as for example at 17) operatively sandwiched between body 10 and thermostat 16, and (ii) a heat conductor plate or means (as for example at 18) operatively sandwiched between the body 10 and thermostat 16, there being an auxiliary heat source (as at 19 and 20, for example) located to separately heat the plate 18 causing auxiliary heat to flow to the thermostat.

As shown in FIGS. 1*a* and 2, thermostat 16 is connected to interrupt operation of the main heat generator 21, and to interrupt operation of the auxiliary heat source 19 and 20 in response to heating of the thermostat 16 to a predetermined high temperature.

Body 10 may comprise a brass tank in which the main heater element is located, mounted to the top plate 12 with terminals 13 and 14. A boss 15 is machined flat and is normally used for mounting the High Limit thermostat 16 with elements 17 and 18 mounted between the thermostat and the boss 15. The thermal isolator plate 17 may be made of polycarbonate plastic or the like. The extended side of plate 18 is formed into a roll or tube 18*a* that fits snuggly around heating resistors 19 and 20 connected in series. The plate 18 could be made of aluminum; however copper has better heat conduction and is typically about 0.043 inches thick. The resistors 19 and 20 and plate 18 constitute the auxiliary heater. It may for example generate about 6 watts of heating power when operating. It is desirable to use thermal grease between the resistor cylindrical surfaces and roll 18*a* to assure good heat flow to the copper. This minimizes the operating temperature of the resistors.

Referring to FIG. 2, power is applied to the main heating element through the manually adjustable thermostat 33 and the High Limit Thermostat 16, both normally closed. When the water temperature reaches the temperature selected by setting of the manually adjustable thermostat 33 mounted on body 10, its contact will open and stop the heating. When the water cools by a small amount, it will re-close. This cycling continues to maintain the desired water temperature. When this type of thermostat fails, it typically fails with the contacts closed. Now only the high limit thermostat is available to prevent the occurance of an unsafe water temperature.

Whenever the heating element 21 is energized, the auxiliary heater is also energized. Heat generated in the auxiliary resistors 19 and 20 is transferred to the copper heat conduction plate 18. Some of this heat is transferred to the high limit thermostat 16 and some of it flows through the thermal isolator plate 17 and is absorbed by the brass casting at mounting surface 15. At the same time, the heat from the water in passage 10*a* is transferred through the brass casting 10, through the thermal isolator plate 17, through the copper heat conductor plate 18 and finally into the high limit thermostat 16. The thermal isolator plate 17 acts as a thermal summing network. Its thickness, shape and thermal conductivity characteristics determine the relative division of heat flow between the two heat sources and to the high limit thermostat. With this arrangement, the temperature experienced by the high limit thermostat will be higher than the water temperature. With the proper selection of parameters, a thermostat set to trip at about 130° F. at its sensing surface, will trip below about 122° F. of water temperature, such recited temperatures being by way of example.

After the high limit thermostat trips, it shuts off both the main heating element and the auxiliary heater. Now, the whole system goes into a cooling mode. Since the high limit thermostat is partially isolated from the brass body or tank 10 by the thermal isolator plate 17, the air cooling on the heat conductor plate 18 will actually cause it to drop its temperature faster than the water temperature drops. From this, it can be seen that the net effect of this system is to lower the effective trip temperature of the thermostat 16 and to raise its reset temperature, both relative to the water temperature. This reduction of effective differential temperature makes it possible to have an acceptably operating high limit system and still meet the UL 122 degree F. requirement.

One problem with the first version of this invention described above is a tolerance build up. The trip temperature is a function of five parameters. The first and largest is the ±5 degrees tolerance (for example) of the high limit thermostat. The second is the effect of line voltage on the auxiliary heater wattage. This contributes ±2 degrees tolerance for a voltage range of 220 V to 240 V. The third is the ±5% tolerance of the auxiliary heater resistors. They contribute a temperature tolerance of approximately ±1 degree. Variations in the characteristics of the thermal isolator plate are approximately neglible. Finally, variations in the air temperature in the heater enclosure contribute approximately ±1 degree F. tolerance. The net result of a build up of these tolerances is that, in the worst case, the trip temperature could be only slightly higher than the upper range of normal use. This could at times result in "nuisance" trips.

Figure 3:
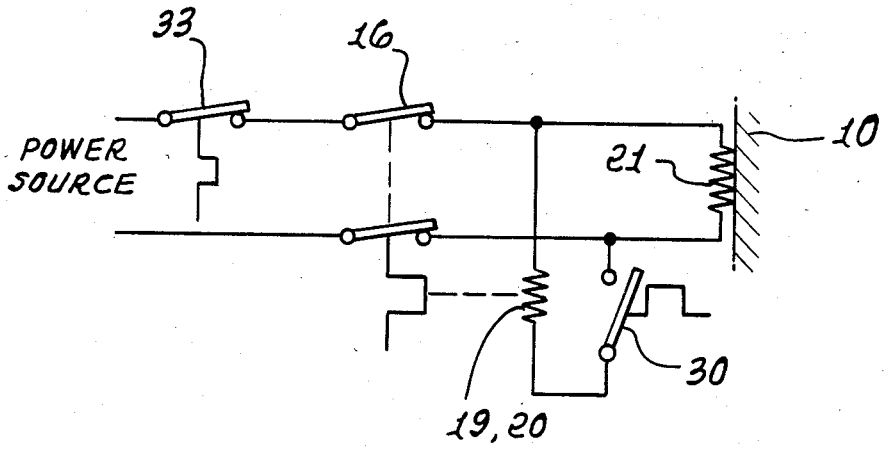
FIG. 3 is another electrical circuit diagram showing a modified form of the invention.

This problem is eliminated in the second version of of this invention. Refer to FIG. 3 for the electrical schematic of the second and preferred version. The only difference from FIG. 2 is the addition of a normally-open, auxiliary high limit thermostat 30 mounted directly on body 10 to receive heat therefrom, and connected in electrical series with auxiliary heater 19, 20. As explained earlier, this is a low current, low differential, self resetting unit. It is also a relatively low cost unit.

In operation, the auxiliary thermostat 30 will normally keep the auxiliary heater 19 and 20 de-energized. If the manually adjustable thermostat 33 connected in electrical series with thermostat 16 fails in the ON-mode, the auxiliary high limit thermostat 30 will close when the water temperature rises to its trip temperature of 116 degrees F. ±5 degrees F. This means that the highest temperature for it to close its contacts is 121 degrees F. and the lowest is 111 degrees F. When its contacts close, the auxiliary heater 19 and 20 is energized and with a nominal wattage of 6 watts, its heat generated will cause the high limit thermostat 16 to trip a short time later.

If the auxiliary high limit thermostat 30 trips because of solar heating of the enclosure 10, it will not energize the auxiliary heater 19, 20 because the manually adjustable thermostat 33 contacts are open. When the solar heating stops, it will reset automatically after cooling.

The only tolerance of significance in this version is the ±5 degrees F. tolerance of the auxiliary high limit thermostat 30. The other factors that added to the tolerance build-up of the first version only affect the time delay between the closure of the auxiliary high limit thermostat 30 and the resulting tripping of the high limit thermostat 16. Since this time delay is in the order of minutes and decreases as the closure temperature of the auxiliary thermostat approaches its upper tolerance limit, it is relatively insignificant when compared to the time required to heat the spa water just one degree.

An important feature of this invention is the interrelation of the auxiliary heater and the thermal isolator plate with the high limit thermostat, all in conjunction with the brass casting system, to make it function like a contractor upon command of the auxiliary high limit thermostat.

The large hole 40 in the thermal isolator plate 17 contributes a unique feature to its functions. The hole does not detract from heat flow from the casting to the thermostat because the temperature sensing portion of the thermostat is outside of the radius of the hole. However, it does reduce the area of contact of the copper plate to the isolator plate. This reduces the heat flow from the copper plate, through the isolator plate and then to the brass casting. As a result, more of the heat generated by the auxiliary heater 19, 20 is applied to the high limit thermostat 16 to serve to raise its temperature.

Figure 4:
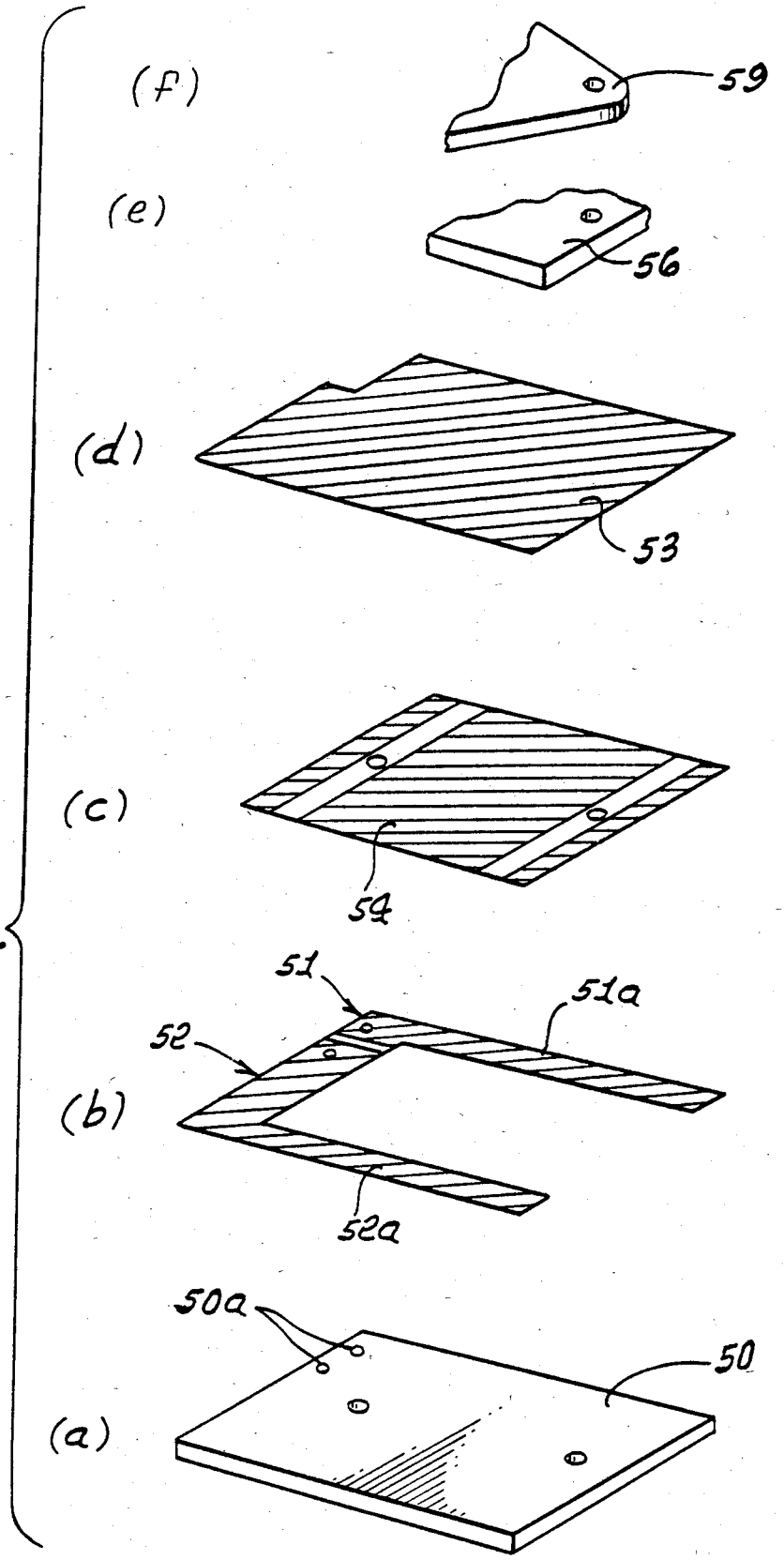
FIG. 4(*a–f*) is a plan view of screen patterns employed in an auxiliary heater.

A printed heater can be used, and an example is shown in FIG. 4(*a–f*) to consist of a rectangular piece of poly-carbonate plastic 50 on which is first printed conductive interconnect paths 51 and 52. A second screening consists of a controlled resistance heater element area 54 which makes contact with the narrow legs 51*a* and 52*a* of the interconnect paths. The third and final screening in the sandwich is a dielectric cover coat 53 to protect and electrically insulate the other elements. A quick connect terminal is riveted in each of the two holes 50*a* at the upper right side. These make contact to each of the interconnect paths, 51 and 52.

This heater is typically used with a flat piece of copper, the size of which is indicated by the rectangular outline 54 in FIG. 4(*c*). This copper plate 54 rests on the dielectric cover coat 53. On top of the copper plate is the high limit thermostat. Its positioning is shown at 59. See also copper best conduction plate 56, which is analogous to heat conduction plate 18.

The copper plate is used as before to transfer the heat from the heater element to the thermostat. In this version, the heat flow paths are, on the average, much shorter than the earlier heaters used, and as a result, faster thermostat activation is achieved. A thin coat of thermally conductive heat sink compound may be applied on the copper plate side that is adjacent to the heater, to insure good thermal transfer.

This assembly is, as before, mounted on the brass tank using thin fibre washers as spacers.

Two further improvements are possible. The first contemplates that in order to have a system of maximum advantage to the user, all thermostats involved should have reset temperatures above the normal spa water temperature of 104° F.

As regards the auxiliary thermostat, close trip tolerance and a narrow differential are desirable. For example, the trip temperature may desirably be about 118°±3° F., and the rest temperature about 109°±3° F. From this it can be seen that in the worst case, the thermostat will always trip at no higher than 121° F. to satisfy the UL 122° F. maximum requirement, and will always reset no lower than 106° F. to satisfy the user convenience requriement.

As regards the high limit thermostat, by picking a trip temperature of about 165°±5° F., the lowest trip temperature will be expectably be 160° F. Subtracting a worst case differential of 55° F. from this gives 105° F., the lowest temperature at which this thermostat will reset. This now satisfies the requirement resetting over 104° F.

In order for the auxiliary heater to cause this high-limit thermostat to be heated up to as high as 170° F., the wattage of the auxiliary heater may be increased as by adding more resistors to the copper plate 18 in FIG. 1.

Since this new trip temperature is so much higher than the water temperature in the tank, it may no longer be useful to incorporate a thermal summing action. Therefore, the thermal isolator plate 17 may be replaced by two insulating washers that simply supply an almost complete thermal separation from the brass tank. The washers used can be made of any low thermal conduction material that can tolerate the temperatures involved, such as fiber. The main function of the brass casting is now to supply mechnical support to the high limit thermostat and the auxiliary heater.

From the above, it can be seen that the combination of a tighter tolerance auxiliary thermostat, and a higher temperature high limit thermostat, activated by the higher wattage auxiliary heater, solves the user convenience reset problem. The improvement mentioned is associated with a non-standard, but possible mode of operation in a spa system. This is a case in which a system has shut-off valves in the water lines ahead of, and after the spa equipment.

These valves are sometimes shut off during spa maintenance operations. If due to an oversight, the valves are not opened again when the system is put back into operation, it is possible for the electric heater to come on with no water flow. If this happens, the stagnant water in the heater tank will heat up very rapidly. The time it takes for the auxiliary heater system to cause the high limit thermostat to trip is on the order of five minutes. This is no problem in the normal function of the thermostat since the rate of change of the spa water temperature is very slow. However, in the no-flow case, the water will be boiling in the heater tank in much less than that time. This could create a high pressure in the system that could be dangerous.

This problem can be solved by the addition of a second auxiliary thermostat similar to the first one, except that its trip temperature is set at about 125°±3° F. It is connected in series with the manually adjustable thermostat and is normally closed until it trips. If the no-flow conditions described above should occur, this thermostat will stop the heating before dangerous temperatures are reached. It also shuts off the auxiliary heater and prevents the high limit thermostat from tripping. When the no-flow situation is corrected, and cool water is allowed to flow through the system, the two auxiliary thermostats will automatically reset.

I claim:

1. In combination with heat source means including a main heat generator and a mounting body, (a) a main high limit thermostat mounted in such relation to said body as to receive heat therefrom, (b) a thermal isolator plate operatively sandwiched between said body and said thermostat, and (c) a heat conduction plate operatively sandwiched between said isolator plate and said thermostat, there being an auxiliary heat source located to separately heat said heat conduction plate to cause heat flow to said thermostat, said isolator plate, heat conduction plate and thermostat being mounted in closely stacked together sequence and in heat transfer relation on said body, the auxiliary heat source carried by said heat conduction plate.

2. The combination of claim 1 wherein said main heat generator is an electrically energized heating element.

3. The combination of claim 2 wherein said body contains a cavity for reception of water heated by said heating element.

4. The combination of claim 3 wherein said body consists of brass and has a mounting surface to which said isolator plate, heat conduction plate, and thermostat are mounted in stacked sequence.

5. The combination of claim 1 wherein said heat conduction plate has an extended portion, and said auxiliary heat source includes electrical resistance in contact with said extended portion.

6. The combination of claim 5 wherein said extended portion defines a roll, said resistance located within said roll.

7. The combination of claim 1 wherein said isolator plate consists of plastic material.

8. The combination of claim 7 wherein said isolator plate contains an aperture therethrough.

9. The combination of claim 1 including a manually adjustable thermostat connected in electrical series with said high limit thermostat.

10. The combination of one of claims 1, 2 or 9 including an auxiliary high limit thermostat connected to receive heat from said body and in controlling relation with said auxiliary heat source.

11. The combination of claim 1 wherein said body contains a heated water passage, and including a spa or swimming pool connected in series with said passage.

12. The combination of claim 1 wherein said auxiliary heat source comprises a sandwich having printed or screened electrically conductive areas.

* * * * *